US005295369A

United States Patent [19]

Garcia

[11] Patent Number: 5,295,369

[45] Date of Patent: Mar. 22, 1994

[54] WATER AND ICE COOLER COMBINATION

[76] Inventor: Kenneth M. Garcia, 931 Riverview, Pueblo, Colo. 81006

[21] Appl. No.: 898,545

[22] Filed: Jun. 15, 1992

[51] Int. Cl.[5] ..... B67D 5/62

[52] U.S. Cl. ..... 62/389; 62/398; 62/457.1; 62/530; 62/459

[58] Field of Search ..... 62/457.1, 457.9, 530, 62/389, 393, 398, 371, 372, 459, 462, 463, 464; 362/92, 94

[56] References Cited

U.S. PATENT DOCUMENTS

| | | | |
|---|---|---|---|
| 288,430 | 11/1883 | Hammerl | 62/398 |
| 346,849 | 8/1886 | Hartmeyer | 62/389 |
| 2,644,882 | 7/1953 | Voda | 362/94 |
| 3,028,208 | 4/1962 | Sharpe | 362/94 |
| 3,395,550 | 8/1968 | Dungan | 62/457.1 |

*Primary Examiner*—John M. Sollecito
*Attorney, Agent, or Firm*—Phillip A. Rein

[57] ABSTRACT

This invention is a water and ice cooler combination including 1) a main cooler container assembly provided with a cool fluid supply assembly to receive and dispense cooled fluid therefrom; and 2) a compartment separation assembly mounted within the main cooler container assembly to provide wet and dry storage areas. The main cooler container assembly includes a rectangular primary housing assembly with an enclosure lid assembly pivotally connected thereto. The cooled fluid supply assembly includes a fluid container compartment mounted in a lower portion of the primary housing assembly and a fluid discharge spigot to selectively remove cooled fluid therefrom. The compartment separation assembly is provided with spaced separator wall members having top edge seal members to seal with the enclosure lid assembly to provide a sealed, dry storage area. An illumination assembly is connected to the enclosure lid assembly to selectively provide illumination to a storage cavity of the primary housing assembly for night time usage.

18 Claims, 2 Drawing Sheets

WATER AND ICE COOLER COMBINATION

PRIOR ART

A patent search was conducted on this invention and revealed the following United States patents:

| U.S. Pat. No. | Invention | Inventor |
|---|---|---|
| 2,104,684 | SANITARY STEEL MILK COLLING CABINET | John E. Wilson Jr. |
| 3,338,068 | COOLER CHEST FOR INDEPENDENT CONTAINER | Herbert M. Piker |
| 3,395,550 | COMPARTMENTED ICE CHEST | Straughter H. Dungan |
| 3,565,320 | REFRIGERATED SHIPPING CONTAINER | Edward L. Osborne |
| 3,959,982 | REFRIGERATION UNIT | Denis et al |
| 4,134,276 | CONTAINER FOR STORAGE OF ARTICLES AND DEVICE FOR UTILIZATION OF SOLID CARBON DIOXIDE | Robert D. Lampard |
| 4,286,440 | COMPARTMENT COOLER | Frank Taylor |
| 4,502,295 | ORGAN HYPOTHERMIC STORAGE UNIT | Luis H. Toledo-Pereyra |
| 4,633,678 | KEG COOLER | Lea et al |
| 4,910,975 | CONDIMENT COOLER | Donald A. Derby |

The Wilson, Jr. patent discloses a milk cooling cabinet having a central container therein to receive food products and cooled from surrounding ice structures.

The Piker patent discloses a cooler chest having independent container structures therein.

The Dugan patent discloses a compartmented ice chest having two separate storage compartments.

The Denis et al patent discloses a refrigeration unit having separate compartments with peripheral seals but separate doors.

The Lampard patent discloses a container for storage of articles having an insulated outer container housing and an insulated inner central housing.

The Taylor patent discloses a compartment cooler having a separate compartment for placing soda pop therein and a central compartment.

The Toledo-Pereyra and Lea et al patents relate to coolers having a means to separate contents therein from the surrounding cooling medium.

The Derby patent discloses a condiment cooler having separate compartments used with a cooler chest type structure.

PREFERRED EMBODIMENT OF THE INVENTION

In one preferred embodiment of this invention, a water and ice cooler combination is operable to be used to cool and insulate beverage cans in a wet storage area, food products in a dry storage area, plus structure for receiving, dispensing, and cooling a fluid such as water therefrom.

The water and ice cooler combination include 1) a main cooler container assembly; 2) a compartment separation assembly mounted within the main cooler container assembly; 3) a cool fluid supply assembly integral with the main cooler container assembly to receive and hold a fluid, such as water, therein for dispensing therefrom; and 4) an illumination assembly to selectively provide illumination to a storage cavity of the main cooler container assembly. The main cooler container assembly includes a primary housing assembly having an enclosure lid assembly pivotally connected thereto.

The primary housing assembly is of a generally rectangular box shape with a central storage cavity including 1) a bottom wall member; 2) side wall members secured to and extended upwardly from the bottom wall member; 3) parallel spaced end wall members secured to the bottom wall member and abutting side wall members; 4) a handle assembly secured to upper respective areas of the opposed end wall members; and 5) insulation members mounted within central and upper areas of the side wall members and end wall members to provide insulation thereto.

The bottom wall member is provided with an inner bottom wall section; the end wall members are each provided with an end inner wall section; and the side wall members are each provided with side inner wall sections to provide respective spacing therebetween.

The handle assembly is provided with handle members secured to respective upper outer wall surfaces of the end wall members and operable for grasping and conveying the entire water and ice cooler combination.

The enclosure lid assembly includes 1) a main lid member of generally rectangular plate shape pivotally connected by a hinge member to an upper, outer edge of one of the side wall members; and 2) a latch assembly for securing the main lid member against an opposite one of the side wall members in a secure but releasable manner.

The main lid assembly member is operable to contact the upper, open portion of the primary housing assembly and enclose the storage area and provided with a top wall; a bottom wall; end walls; and side walls, all being interconnected to provide an air insulation space.

The latch assembly includes a stationary anchor member secured to the main lid member and a lockable latch member secured to an adjacent side wall member of the primary housing assembly. The latch assembly secures the main lid member against an outer, upper edge of the primary housing assembly in a conventional manner.

The compartment separation assembly includes a pair of spaced upright separator wall members, each having a top edge seal member connected to an upper end thereof to seal with the bottom wall of the main lid member of the enclosure lid assembly. The separator wall members are operable to provide a sealed dry storage area centrally of the main housing assembly.

The cool fluid supply assembly includes 1) a fluid container compartment in a lower portion of the primary housing assembly; 2) a fluid discharge spigot operably connected to the fluid container compartment to selectively dispense fluid therefrom; 3) an equalizer tube member mounted within a lower portion of the primary housing assembly to provide a fluid channel between wet storage areas or compartments on outer sides of the separator wall members of the compartment separation assembly to allow fluid flow therebetween; and 4) a fluid inlet assembly mounted within a side wall member of the primary housing assembly to add inlet fluid to, and escape of air from, the fluid container compartment.

The fluid container compartment includes a bottom portion; an end portion; and side portions, all interconnected to form a rectangular type container structure operable to receive fluid therein for storage, cooling, and dispensing thereof.

The fluid discharge spigot includes a discharge housing having a spigot member mounted thereon being operable to selectively open and close access to the fluid container compartment to selectively discharge fluid therefrom.

The equalizer tube member is provided with a fluid flow channel allowing fluid, such as obtained from melted ice, to flow between wet storage compartments or areas on respective outer sides of the separator wall members.

The fluid inlet assembly includes an inlet fluid tube member and an air release tube member which are parallel, adjacent, and extended vertically from a top of one side wall member of the primary housing assembly downwardly to the fluid container compartment. The fluid inlet assembly provides a fluid flow channel to the fluid container compartment and includes a tube closure flap assembly operably connected to adjacent open ends of the inlet fluid tube member and the air release tube member for sealing purposes.

The tube closure flap assembly includes a flap member mounted on a pivot shaft contained within a flap receiver indentation. The flap member is provided with a fluid inlet closure plug and an air release closure plug and being rotatable about the pivot shaft. The flap member is pivotal from an open upper condition downwardly to place the fluid inlet closure plug within an upper, open end of the inlet fluid tube member and, concurrently, the air release closure plug within an upper, open end of the air release tube member to provide respective sealing functions therewith.

The illumination assembly includes a light member connected to battery members and operable through a switch member to selectively energize the light member to achieve illumination for night time usage.

OBJECTS OF THE INVENTION

One object of this invention is to provide a water and ice cooler combination including a compartment separation assembly to present 1) a wet storage area to receive products such as beverage cans and ice members in a wet condition; and 2) a dry storage area to receive items such as sandwiches, fruit, bread, and the like which are kept in a dry condition.

Another object of this invention is to provide a water and ice cooler combination having a main cooler container assembly with a rectangular primary housing assembly selectively closed by an enclosure lid assembly and, mounted within the primary housing assembly, a cool fluid supply assembly operable to receive and hold a fluid therein with a fluid discharge spigot for selectively releasing fluid therefrom.

One other object of this invention is to provide a water and ice cooler combination including a main cooler container assembly to provide a rectangular storage cavity separated into wet storage areas and a dry storage area and having an illumination assembly which is selectively operable to light the storage cavity for usage in darkened areas.

One further object of this invention is to provide a water and ice cooler combination having unique features of 1) a primary housing assembly with dry and wet storage areas; 2) a cool fluid supply assembly to receive a fluid therein for cooling and subsequent discharge through a spigot member; and 3) an illumination assembly operable to selectively provide illumination to the storage areas.

Still, another object of this invention is to provide a water and ice cooler combination which is readily portable to a desired location; operable to provide separate, sealed, we and dry storage areas; operable to receive, store, and cool a fluid therein for subsequent dispensing; economical to manufacture; and substantially maintenance free.

Various other objects, advantages, and features of the invention will become apparent to those skilled in the art from the following discussion, taken in conjunction with the accompanying drawings, in which:

FIGURES OF THE INVENTION

Figure 1:
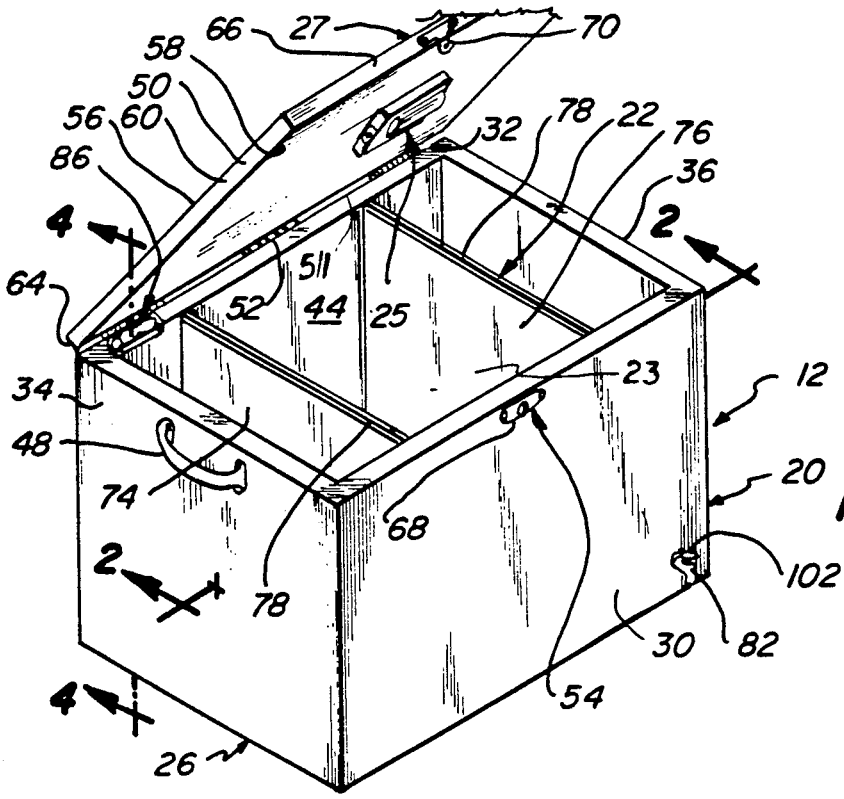
FIG. 1 is a perspective view of the water and ice cooler combination of this invention.

The following is a discussion and description of preferred specific embodiments of the water and ice cooler combination of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and, in particular to FIG. 1, a water and ice cooler combination of this invention, indicated generally at 12, is operable to hold beverage cans 14 and ice members 18 in wet storage areas and food products 16 in a central dry storage area.

The ice members 18 are operable to conventionally cool the beverage cans 14 and provide a cooling effect to the adjacent, surrounding, contacting walls in a conventional manner.

The water and ice cooler combination 12 includes 1) a main cooler container assembly 20; 2) a compartment separation assembly 22 mounted within &he main cooler container assembly 20; 3) a cool fluid supply assembly 24 mounted within the main cooler container assembly 20 to receive a fluid therein; and 4) an illumination assembly 25 connected to the main cooler container assemblV 20 to provide selective illumination to a storage cavity 23 as required.

The main cooler container assembly 20 includes a primary housing assembly 26 having an enclosure lid assembly 27 pivotal about one edge to enclose and reveal the storage cavity 23 of the main cooler container assembly 20.

The primary housing assembly 26 includes 1) a bottom wall member 28; 2) spaced opposed upright parallel side wall members 30, 32 integral with the bottom wall 28; 3) end wall members 34, 366 integral with adjacent portions of the bottom wall member 28 and the side wall members 30, 32; 4) a handle assembly 38 connected to upper, outer portions of the side wall members 30, 32; and 5) insulation members 40 connected to central and upper portions of the side wall members 30, 32 and end wall members 34, 36.

The bottom wall member 28 has an adjacent inner wall section 42; the side wall members 30, 32 each have spaced inner wall sections 44; and the end wall members 34, 36 each have spaced end inner wall sections 46, all wall sections 42, 44, 46 provide an area therebetween.

The areas between the bottom wall member 28, side wall membes 30, 32, and end wall members 34, 36 and respective wall sections are operable to receive a fluid therebetween or the insulation material 40 as noted in the drawings.

The handle assembly 38 is provided with a pair of handle members 48, one each secured to upper respective outer surfaces of the end wall members 34, 36 for grasping, lifting, and conveyance of the water and ice cooler combination 12.

The insulation member 40 may be of a foam insulation or other similar material preferrably being of lightweight and having a high cooling efficiency in providing insulation properties to the storage cavity 23 of the primary housing assembly 26.

Figure 2:
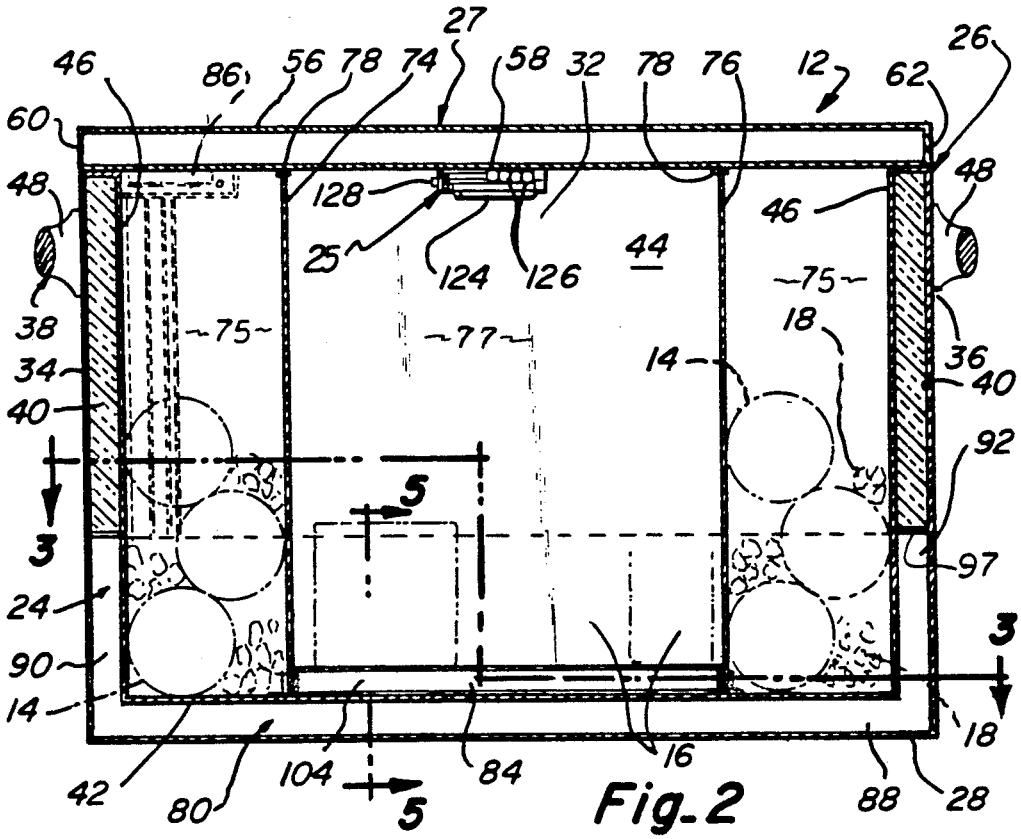
FIG. 2 is an enlarged sectional view taken along line 2—2 in FIG. 1 having an enclosure lid assembly in a closed sealed condition.
Figure 3:
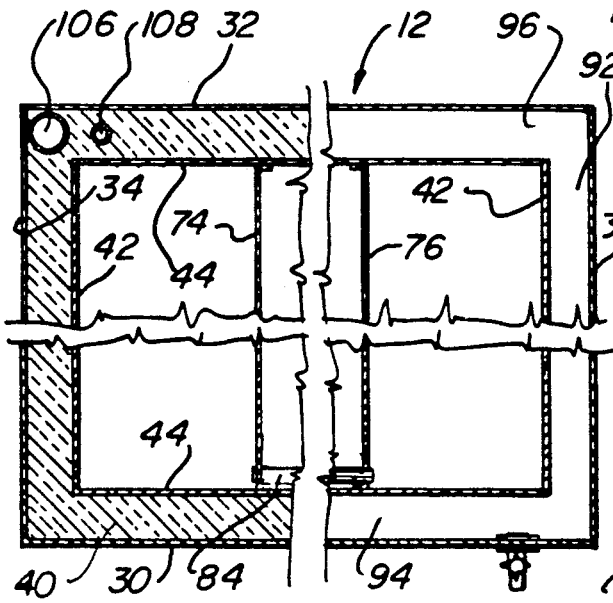
FIG. 3 is a foreshortened sectional view taken along line 3—3 in FIG. 2.

The enclosure lid assembly 27 is of a rectangular plate shape having 1) a main lid member 50 of rectangular shape; 2) a hinge member 52 to pivotally connect one edge of the main lid member 50 to an upper, outer edge 51 of the side wall member 32 as noted in FIG. 1; and 3) a latch assembly 54 connected to the primary housing assembly 26 and the main lid member 50 for securing in an enclosed condition as shown in FIG. 2.

The main lid member 50 includes 1) a top wall 56; 2) a bottom wall 58; end walls 60, 62 interconnecting the top wall 56 and the bottom wall 58; and 3) side walls 64, 66 interconnecting the top wall 56, bottom wall 58, and end walls 60, 62 to provide an insulation space between the top wall 56 and the bottom wall 58.

The hinge member 52 may be of a piano type hinge or, as illustrated, three separate hinge members and constructed to restrict vertical pivotal movement of the main lid member 50 to a position parallel to the side wall member 32.

The latch assembly 54 includes a stationary anchor member 68 secured to an outer surface of the side wall member 30 and a lockable latch member 70 secured to an outer surface of the side wall 66 of the main lid assembly 50 and being selectively engagable with the stationary anchor member 68. The latch assembly 54 is operable to selectively secure the enclosure lid assembly 27 against the primary housing assembly 26 in a conventional manner.

As noted in FIGS. 1 and 2, the compartment separation assembly 22 is provided with spaced separator wall members 74, 76, each having a top edge seal member 78 engagable with the bottom wall 58 of the main lid member 50 to provide sealing engagement therewith. This sealing engagement is operable to provide a pair of wet storage areas 75 positioned on opposite sides of a dry storage area 77 for reasons to be explained.

The spaced separator wall members 74, 76 are sealingly connected to the opposed side inner wall sections 44 of the side wall members 30, 32 so that the dry storage area 77 will not receive unwanted moisture therein.

The cool fluid supply assembly 24 is provided with 1) a fluid container compartment 80 to receive fluid therein; 2) a fluid discharge spigot 82 operably connected to the fluid container compartment 80 for selective dispensing of fluid therefrom; 3) an equalizer tube member 84 interconnected between the wet storage areas 75 and the dry storage area 77; 4) a fluid inlet assembly 86 mounted within a space between the side wall member 32 and adjacent side inner wall section 44 and connected to the fluid container compartment 80 for reasons to become obvious.

The fluid container compartment 80 includes 1) a bottom portion 88; 2) end portions 90, 92; and 3) side portions 94, 96 which cooperate to form an integral storage chamber to receive fluid therein for cooling by the ice members 18 in the wet storage areas 75.

Figure 5:
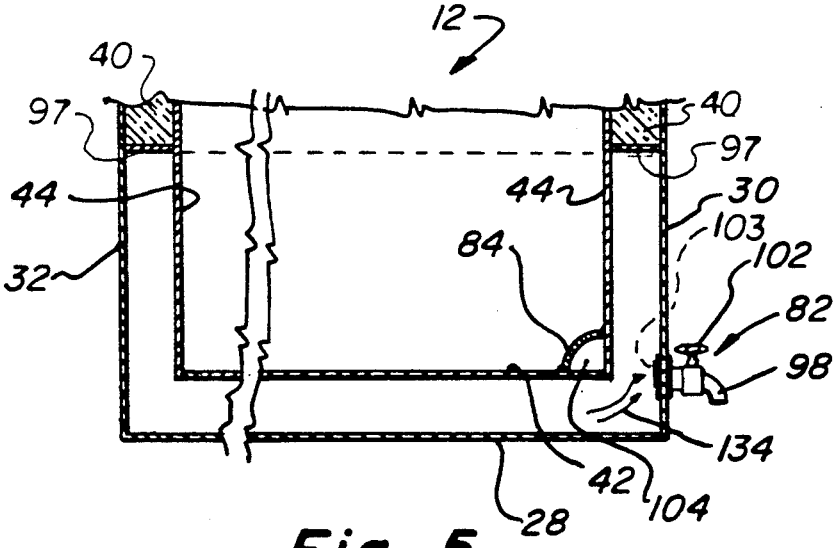
FIG. 5 is an enlarged fragmentary foreshortened view taken along line 5—5 in FIG. 2.

As noted in FIG. 5, the fluid discharge spigot 82 includes a discharge housing 98 having a spigot member 102 mounted thereon. A fluid discharge channel 103 is present through the discharge housing 98 and selectively closed by the spigot member 102 in a conventional manner.

As noted in FIG. 5, the equalizer tube member 84 is of a quarter circle shape in transverse cross section and encloses a central fluid flow channel 104. The flow channel 104 allows fluid flow between the wet storage areas 75 to maintain a constant fluid level therebetween caused by melting of the ice members 18.

The fluid inlet assembly 86 includes 1) an inlet fluid tube member 106; 2) an air release tube member 108; and 3) a tube closure flap assembly 110 operably engagable with upper, open ends of the adjacent parallel inlet fluid tube member 106 and the air release tube member 108.

Figure 4:
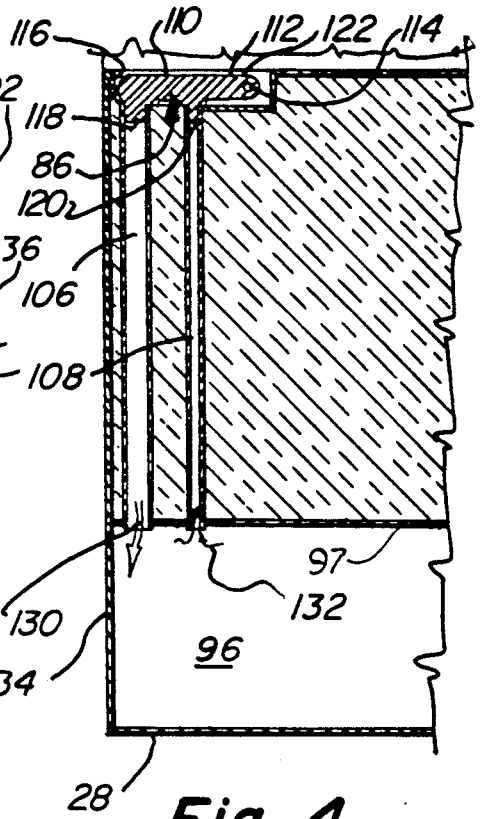
FIG. 4 is an enlarged fragmentary sectional view taken along line 4—4 in FIG. 1.

As noted in FIG. 4, the inlet fluid tube member 106 and the air release tube member 108 have adjacent lower ends secured to a top wall 97 to provide fluid flow into the side portions 96 of the fluid container compartment 80.

The upper ends of the inlet fluid tube member 106 and the air release tube member 108 are selectively engagable with the tube closure flap assembly 110 for sealing purposes and moved to an open condition for adding fluid to the inlet fluid tube member 106.

More particularly, the tube closure flap assembly 110 includes a flap member 112 which is mounted on a pivot shaft 114 which, in turn, is mounted within a flap receiver indentation 116 formed in the side wall member 32 and adjacent side inner wall sections 44 (FIG. 4).

The flap member 112 is preferrably constructed of a resilient material such as rubber having a laterally extended fluid inlet closure plug 118, an air release closure plug 120, and a integral connector section 122 to receive the pivot shaft 114 for pivotal movement thereabout. It is obvious that the flap member 112 forms a seal with the upper, open ends of the inlet fluid tube member 106 and the air release tube member 108.

USE AND OPERATION OF THE INVENTION

In the use and operation of the water and ice cooler combination 12 of this invention, refer to FIG. 1 whereupon the enclosure lid assembly 27 has the main lid member 50 pivotal about the hinge member 52 to an open condition revealing the storage cavity 23. During night time usage, it is obvious that the illumination assembly 25, through the switch member 128, can be energized with the light member 124 illuminating the storage cavity 23.

Next, the user of the water and ice cooler combination 12 may desire to place a fluid, such as water or other beverages, within the fluid container compartment 80 as noted by an arrow 130 in FIG. 4. At this time, the tube closure flap assembly 110 would have the flap member 112 pivoted about the pivot shaft 114 to an open condition.

Then, the user would add fluid into the open, upper end of the inlet fluid tube member 106. As the fluid is added, any air contained within the fluid container compartment 80 would be forced upwardly and outwardly through the air release tube member 108 as noted by an arrow 132.

The flap member 112 is then returned to a sealed condition with the fluid inlet closure plug 118 and the air release closure plug 120 engagable with the respective open ends of the inlet fluid tube member 106 and the air release tube member 108 as noted in FIG. 4.

The user of the water and ice cooler combination 12 may desire to place beverage cans 14 and ice members 18 into the spaced wet storage areas 75 as noted in FIG. 2. The user can place food products 16 within the central dry storage area 77 to keep in a cool but dry condition for sandwiches, fruit, breads, potato chips, and the like.

It is noted that the spaced separator wall members 74, 76 prevent the ice members 18 and melted fluid in the wet storage areas 75 from entering into the dry storage area 77 while achieving a cooling effect to the dry storage area 77.

The user can move the main lid member 50 to a horizontal enclosed condition and secure same against the primary housing assembly 26 through the latch assembly 54 in a conventional manner.

At this time, the handle assembly 38 and, more particularly, the respective handle members 48 may be grasped for lifting and conveying the entire water and ice cooler combination 12 to the trunk of a vehicle, a boat, or other desired area.

On reaching a desired location, such as a boat or recreational area, it is noted that the ice members 18 would have cooled the beverage cans 14 in the wet storage areas 75 and the food products 16 within the dry storage area 77. If desired, the spigot member 102 can be rotated to discharge fluid from within the fluid container compartment 80 through the fluid discharge channel 103 as noted by an arrow 144 in FIG. 5 into a drinking cup or the like.

The equalizer tube member 84 allows for fluid in the wet storage areas 75 to freely flow therebetween so as to maintain an equal fluid level within the wet storage areas 75 which is desirable for efficient and efficient cooling of the fluid within the fluid container compartment 80.

The water and ice cooler combination 12 of this invention is unique in providing both wet storage areas 75 and a dry storage area 77 in a sealed manner and means for equalizing fluid level and pressure between the wet storage areas 75. The dry storage area 77 is important in providing storage for food products 16 that are desired to be kept cool but without contact to moisture or water such as sandwiches, salads, fruit, and other such items.

The water and ice cooler combination of this invention is sturdy in construction; economical to manufacture; easy to use; and substantially maintenance free.

While the invention has been described in conjunction with preferred specific embodiments thereof, it will be understood this description is intended to illustrate and not to limit the scope of the invention, which is defined by the following claims:

I claim:

1. A water and ice cooler combination operable to provide wet and dry storage areas plus receiving, storing, cooling, and dispensing a fluid therefrom, comprising:

a) a main cooler container assembly having a primary housing assembly comprising a pair of oppositely opposed end wall members and side wall members with a storage cavity comprising two separator wall members, each spaced from and parallel to said opposing end wall members, thereby defining a dry storage area, between said separator wall members, and two wet storage areas defined between each of said separator wall members and one of said end wall members, said wet and dry storage areas being further bound by a bottom wall, said main cooler container further comprising an enclosure lid assembly pivotally connected thereto;

b) said primary housing assembly having a wall member cooperating with said bottom wall thereby defining a fluid container compartment;

c) a fluid supply assembly mounted in said primary housing assembly in contact with said storage cavity to be cooled therefrom; and d) said fluid supply assembly having a fluid discharge assembly to selectively remove fluid therefrom.

2. A water and ice cooler combination as described in claim 1, wherein:

a) said fluid discharge assembly having a spigot member mounted on an outer surface of said primary housing assembly and extended outwardly therefrom and connected to said fluid container compartment adjacent said outer surface being operable to selectively open said spigot member to discharge fluid from said fluid container compartment.

3. A water and ice cooler combination as described in claim 1, including:

a) a top edge seal member connected to said separator wall member engagable with said enclosure lid assembly when in a closed condition against said primary housing assembly to prevent moisture from said wet storage area from entering said dry storage area.

4. A water and ice cooler combination as described in claim 3, wherein:

a) said wet storage areas are in contact with the fluid in said fluid container compartment in said primary housing assembly for efficient cooling of the fluid; and b) said compartment separation assembly includes an equalizer tube member to interconnect said wet storage areas to to allow free passage of fluid therebetween to continuously achieve equal cooling of the fluid in said fluid container compartment in said primary housing assembly.

5. A water and ice cooler combination as described in claim 1, wherein:

a) a portion of said fluid container compartment is comprised of a bottom portion with integral, upright extending end portions and side portions; and b) said bottom portion, said end portions, and said side portions operable to be filled by the fluid and form a portion of an outer periphery of said storage cavity and be cooled from contents, such as ice, in said storage cavity.

6. A water and ice cooler combination as described in claim 5, wherein:

a) another portion of said area in said primary housing is filled with insulation material; and b) said insulation material and the fluid cooperated to insulate said storage cavity when said area is filled with the fluid.

7. A water and ice cooler combination as described in claim 1, wherein:

a) said fluid supply assembly includes a fluid inlet assembly connected to said fluid container compartment and mounted in said primary housing assembly;

b) said fluid inlet assembly includes an inlet fluid tube member and an air release tube member; and c) said inlet fluid tube member having one end extended through said primary housing assembly and another end connected to said fluid container compartment;

whereby a fluid may be added through said inlet fluid tube member to selectively supply fluid into said fluid container compartment.

8. A water and ice cooler combination as described in claim 7, wherein:

a) said fluid inlet assembly includes a tube closure flap assembly operable in a closed condition to engage said inlet fluid tube member and said air release tube member in a sealed condition and movable to an open condition to add fluid into said inlet fluid tube member.

9. A water and ice cooler combination as described in claim 8, wherein:

a) said air release tube member having one end opened externally of said primary housing assembly and another end extended into said fluid container compartment;

whereby said air release tube member, when in the open condition, is operable to release air within said fluid container compartment when adding fluid into said inlet fluid tube member for ease of filling of said fluid container compartment.

10. A water and ice cooler combination operable to provide wet and dry storage areas plus receiving, storing, cooling, and dispensing a fluid therefrom, comprising:

a) a main cooler container assembly having a primary housing assembly comprising a pair of oppositely opposed end wall members and side wall members with a storage cavity and an enclosure lid assembly pivotally connected thereto;

b) a compartment separation assembly means comprising two separator wall members, each spaced from and parallel to said opposing end wall members, thereby defining a dry storage area, between said separator wall members, and two wet storage areas defined between each of said separator wall members and one of said end wall members, said wet and dry storage areas being further bound by a bottom wall; said primary housing assembly having a wall member cooperating with said bottom wall thereby defining a fluid container compartment; and

11. A water and ice cooler combination as described in claim 10, wherein:

a) said compartment separation means includes two of said separator wall members having one of said seal members on each to divide said storage areas into a pair of wet storage areas with a central dry storage area therebetween;

b) said wet storage areas in contact with said fluid container compartment operable to achieve cooling of the fluid therein; and c) an equalizer tube member interconnects said wet storage areas to allow the free flow of fluid therebetween and equal fluid level therein for maximum efficiency in cooling the fluid in said fluid container compartment.

12. A water and ice cooler combination as described in claim 10, including:

a) a fluid supply assembly mounted in said enclosed storage area in said primary housing assembly in contact with said storage cavity to be cooled therefrom; and b) said fluid supply assembly having a fluid discharge assembly to selectively remove fluid from said enclosed storage area.

13. A water and ice cooler combination as described in claim 10, wherein:

a) said fluid supply assembly includes a fluid inlet assembly connected to said fluid container compartment and mounted in said primary housing assembly;

b) said fluid inlet assembly includes an inlet fluid tube member and an air release tube member; and c) said inlet fluid tube member having one end extended through said primary housing assembly and another end connected to said fluid container compartment;

whereby a fluid may be added through said inlet fluid tube member to selectively supply fluid into said fluid container compartment.

14. A water and ice cooler combination as described in claim 13, wherein:

a) said fluid inlet assembly includes a tube closure flap assembly operable in a closed condition to engage said inlet fluid tube member and said air release tube member in a sealed condition and movable to an open condition to add fluid into said inlet fluid tube member.

15. A water and ice cooler combination as described in claim 14, wherein:

a) said air release tube member having one end opened externally of said primary housing assembly and another end extended into said fluid container compartment;

whereby said air release tube member, when in the open condition, is operable to release air within said fluid container compartment when adding fluid into said inlet fluid tube member for ease for filling of said fluid container compartment.

16. A water and ice cooler combination operable to provide wet and dry storage areas plus receiving, storing, cooling, and dispensing a fluid therefrom, comprising:

a) a main cooler container assembly having a primary housing assembly with a storage cavity and an enclosure lid assembly pivotally connected thereto;

b) a compartment separation assembly having a separation wall member mounted in said primary housing assembly to provide a wet storage area and a dry storage area;

c) a seal member is connected to an edge of said separator wall member which contacts and seals with said enclosure lid assembly when in a closed condition against said primary housing assembly to prevent access to said dry storage area by outside moisture;

d) a fluid supply assembly mounted in said primary housing assembly in contact with said storage cavity to be cooled therefrom;

e) said fluid supply assembly having a fluid discharge assembly to selectively remove fluid from said fluid supply assembly;

f) said fluid supply assembly includes a fluid inlet assembly connected to said fluid container compartment and mounted in said primary housing assembly;

g) said fluid inlet assembly includes an inlet fluid tube member and an air release tube member; and h) said inlet fluid tube member having one end extended through said primary housing assembly and another end connected to said fluid container compartment;

whereby a fluid may be added through said inlet fluid tube member to selectively supply fluid into said fluid container compartment.

17. A water and ice cooler combination as described in claim 16, wherein:

a) said fluid inlet assembly includes a tube closure flap assembly operable in a closed condition to engage said inlet fluid tube member and said air release tube member in a sealed condition and movable to an open condition to add fluid into said inlet fluid tube member.

18. A water and ice cooler combination as described in claim 17, wherein:

a) said air release tube member having one end opened externally of said primary housing assembly and another end extended into said fluid container compartment;

whereby said air release tube member, when in the open condition, is operable to release air within said fluid container compartment when adding fluid into said inlet fluid tube member for ease of filling of said fluid container compartment.

* * * * *